United States Patent [19]

McKinney

[11] Patent Number: 5,046,898

[45] Date of Patent: Sep. 10, 1991

[54] RETAINING WALL AND BUILDING BLOCK THEREFOR

[76] Inventor: Gary S. McKinney, 4621 River Road, Delta, British Columbia, Canada, V4K 1R9

[21] Appl. No.: 540,757

[22] Filed: Jun. 20, 1990

[51] Int. Cl.[5] ..... E02D 3/02

[52] U.S. Cl. ..... 405/286; 405/284; 405/272

[58] Field of Search ..... 405/284, 286, 272, 262, 405/267

[56] References Cited

U.S. PATENT DOCUMENTS

| | | | |
|---|---|---|---|
| 2,908,139 | 10/1959 | Horton et al. . | |
| 2,960,797 | 11/1960 | Frehner . | |
| 4,266,890 | 5/1981 | Hilfiker | 405/286 |
| 4,341,491 | 7/1982 | Naumann | 405/262 X |
| 4,407,612 | 10/1983 | Van Weele | 405/284 X |
| 4,592,678 | 6/1986 | McNinch, Jr. et al. | 405/284 |
| 4,661,023 | 4/1987 | Hilfiker | 405/262 |
| 4,798,499 | 1/1989 | Yamada | 405/286 |
| 4,825,619 | 5/1989 | Forsberg | 405/286 X |
| 4,914,876 | 4/1990 | Forsberg | 405/284 X |
| 4,936,712 | 6/1990 | Glickman | 405/284 |

*Primary Examiner*—Dennis L. Taylor

*Assistant Examiner*—J. Russell McBee

*Attorney, Agent, or Firm*—Shlesinger Arkwright Garvey

[57] ABSTRACT

An elongated building block has spaced apart inner and outer faces and top and bottom faces and complementary end portions with openings therein. The openings of the block are disposed on a straight longitudinal axis and clearance is located adjacent the longitudinal axis and a central portion of the inner face of the block. When horizontal rows of similar blocks are stacked one upon the other, end portions of the blocks in one row are positioned above central portions of blocks in an adjacent row, so the joints between the blocks are staggered. Generally vertical connecting rods pass through aligned openings to connect alternate rows of the blocks together. Clearance in alternate rows of blocks exposes intermediate portions of the connecting rods. When used as an embankment retaining wall, generally horizontal tie back rods embedded in the embankment connect with the exposed intermediate portions of the connecting rods passing between alternate rows of blocks. Exposed intermediate portions of the connecting rods provide a relatively wide tolerance for connection to the tie back rods.

20 Claims, 3 Drawing Sheets

RETAINING WALL AND BUILDING BLOCK THEREFOR

BACKGROUND OF THE INVENTION

The invention relates to a building block for walls, in particular retaining walls such as those used to support earthen embankments.

Earthen embankments having relatively steep slopes and heights above a meter are usually stabilized by a retaining wall. Some retaining walls are made from poured reinforced concrete, and can be labour intensive, as they require considerable preparation for concrete form work. Poured retaining walls are usually only economical where it is possible to provide large quantities of ready-mixed concrete, for example as supplied by a concrete pumping truck, which usually requires road access. In some sites, it is not convenient or possible to provide easy access for pouring concrete, and individual building blocks are used. On relatively steep, inaccessible embankments, it is important that the blocks can be man-handled easily without requiring mechanized equipment. Such blocks must be sufficiently light for one or two men to carry, e.g. about 40–80 kgs, and thus this type of block will be relatively small. Small blocks can be cemented in place, or can be supported and interconnected using reinforcing bars which serve as connecting rods which pass through appropriate openings in the blocks. Relatively low retaining walls of cemented-together building blocks are usually appropriate in relatively inaccessible areas, but difficulties have been encountered in stabilizing relatively high retaining walls of cemented-together blocks, that is walls higher than three meters. The forces incurred in retaining embankments higher than about three meters tend to become excessive, causing the wall to become unstable. It is known to provide a rearward and upward slope to such walls, termed "batter", but, this slope does not provide sufficient stability in all cases.

It is also known to provide tie back rods, concrete dowels, etc. which pass generally horizontally into an embankment and secure the retaining wall to the embankment. Such tie back rods can be either driven or augered into an embankment already in place as the wall is built up, or can be laid upon backfill material which is deposited sequentially to form the embankment as the wall is built up. While use of tie back rods of this type has, in general, been successful in stabilizing relatively high walls, difficulties have been encountered in connecting the tie rod to the wall itself. Often, steel rings or other connectors are cast or embedded into a rear face of the building block, and connect the block to the tie back rods as the wall is built. Such cast-in connectors increase the cost of the building block, and increase difficulties of installation. It can be difficult to fasten the connectors to the tie back rods as relatively close installation tolerances are required to ensure that the tie back rod and the respective connector can be connected together when installed. Clearly, the connector must be embedded sufficiently within the block to withstand restraining forces from the tie back rod. This usually requires a considerable amount of reinforcing bar embedded within the block, increasing cost and weight of the block.

Examples of building blocks for earthen embankment retaining walls are disclosed in patents as follows. U.S. Pat. No. 4,798,499 (Yamada) discloses a block or panel having an inwardly curved arch member and a straight chordal member. The chordal member is pre-stressed by a rod and thus is subjected to compression forces, and the arch member is subjected to tension. The blocks are stacked in vertical and horizontal rows without staggering or alternating of joints. Horizontal tie back members cooperate directly with joints between adjacent panels to restrain the wall against pressure from the embankment. U.S. Pat. No. 2,960,797 (Frehner) discloses a building block structure in which blocks are V-shaped or curved and are disposed in rows in which joints are staggered relative to joints of an adjacent row. Spaces between the rows can be provided to receive plants. U.S. Pat. No. 2,908,139 (Horten et al) discloses natural stone blocks reinforced by insertion of prestressing elements which are subjected to tension to strengthen the stone. U.S. Pat. No. 4,266,890 (Hilfiker) discloses a wall fabricated from blocks which are interconnected with vertical tie rods and horizontal tie back rods.

In many of the patents shown, it is known to stack the blocks so as to be inclined in an upwardly and a rearwardly leaning slope, and also to provide means for plants to grow between blocks, or in special recesses within the blocks. In many of the structures known to the present inventor, connections between the vertical connecting rods, or horizontal tie back rods can be difficult to assemble while the wall is being built and commonly result in stress concentrations in the block, causing premature failure of the block.

To the inventor's knowledge, no blocks have been designed in which the connecting rods used to connect horizontal rows of blocks together can be directly connected to horizontal tie back rods in the embankment.

SUMMARY OF THE INVENTION

The invention reduces the difficulties and disadvantages of the prior art by providing a building block for use in a retaining wall in which horizontal rows of the blocks are connected together vertically by connecting rods, and, if needed, tie back rods within the embankment are connected directly to the connecting rods. This enables a direct transfer of force between the tie back rods and the connecting rods, reducing any tendency of the prior art connectors to pull out of the blocks. Furthermore, for larger sizes of blocks, reinforcing rods are used to strengthen the blocks by positioning the reinforcing rods within the blocks so as to be closely adjacent the connecting rods used to connect adjacent rods together. In this way, force on the connecting rod from the tie back rods is transferred to the reinforcing rod within the block, so as to expose the concrete disposed between the connecting rod and the reinforcing rod to minimal stresses.

A building block according to the invention comprises spaced apart inner and outer faces and spaced apart top and bottom faces, the faces defining a transverse cross-section of the block. The block further comprises first and second end portions which are complementary to each other and have respective openings therein positioned to permit adjacent end portions of adjacent blocks to cooperate with each other so that pairs of adjacent openings are alignable with each other. The openings of a particular block are disposed on a straight longitudinal axis of the block. The block further comprises a clearance means located adjacent the longitudinal axis and adjacent a central portion of the inner face of the block.

A retaining wall according to the invention comprises a plurality of stacked blocks as recited above arranged in horizontal rows, with one row on top of the other. The end portions of the blocks in a lower row are disposed beneath central portions of the blocks in an upper row. A plurality of generally vertical connecting rods cooperate with the blocks. Each connecting rod passes through at least two pairs of aligned openings in two vertically spaced apart rows of blocks, the rows of blocks being separated by at least one intermediate row of blocks. An intermediate portion of a particular rod passes through the clearance means of a block in the intermediate row of blocks, the intermediate portion of the particular rod being exposed for access. When used to support a relatively high embankment, a plurality of generally horizontal tie back rods are used to tie the wall to the embankment. Each tie back rod has an outer end connected to an intermediate portion of a respective connecting rod, and an inner end restrained against movement within the embankment.

A detailed disclosure following, related to drawings, describes a preferred embodiment of the invention which is capable of expression in structure other than that particularly described and illustrated.

DETAILED DISCLOSURE

FIGS. 1 THROUGH 4

Figure 2:
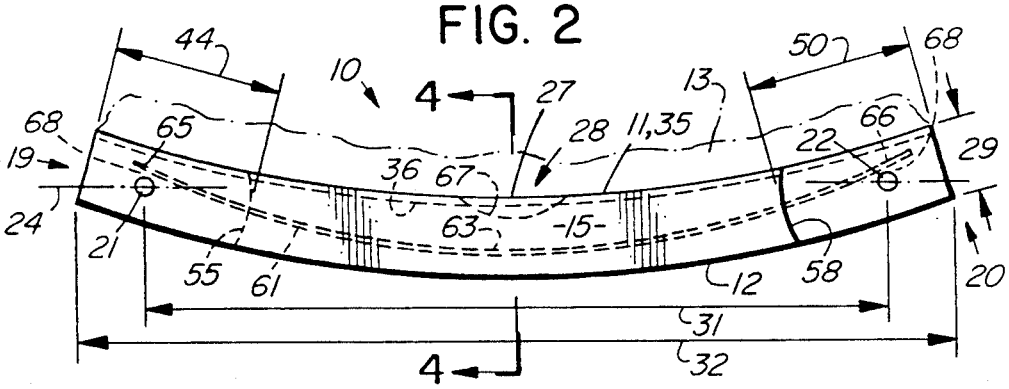
FIG. 2 is a top plan of the block.
Figure 4:
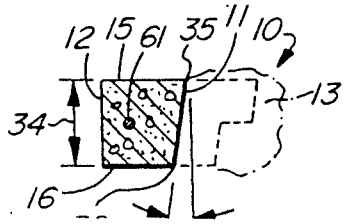
FIG. 4 is a simplified cross-section of the block as seen from Line 4—4 of FIG. 2.

A building block 10 according to the invention has spaced apart inner and outer faces 11 and 12 respectively. The terms "inner and outer" are defined with respect to an embankment 13, a portion of which is shown in FIGS. 2 and 4. The embankment is retained by a retaining wall made of the blocks 10, and has an outer face contacting the inner face 11. The block 10 also has generally parallel horizontal top and bottom faces 15 and 16, the faces 11, 12, 15 and 16 defining a transverse cross-section of the block as shown in FIG. 4.

The block has first and second end portions 19 and 20, the end portions being complementary to each other and having respective first and second vertical openings 21 and 22 therein which are disposed on a straight longitudinal axis 24 of the block. The end portion 19 has an upper face coplanar with the face 15, and the end portion 20 has a lower face coplanar with the face 16.

The inner face 11 is generally concave so that a central portion 27 thereof is recessed or displaced radially relative to the end portions 19 and 20 to form a clearance means 28 adjacent the axis 24 and the central portion 27 for reasons to be described. The longitudinal axis 24 extends as a chord with respect to the inner face 11, and between the openings 21 and 22 in the opposite end portions of the block. The outer face 12 is generally convex and, as drawn, is spaced from the inner face 11 at a generally constant perpendicular distance, so that the block has an essentially constant width 29 along its length, measured at a fixed distance from either horizontal face. Preferably, the inner and outer faces 11 and 12 are portions of circular arcs centered on a common center, not shown, the inner face 11 having a mean radius of between 1 meter and 5 meters. Thus the width 29 of the block is between 150 mm and 600 mm, and the block forms an approximate arcuate outline when viewed from above. The above dimensions refer to a block having an effective length 31 between centers of the openings 21 and 22 of between 1 meter and 3 meters, and an overall length 32 between the outer end portions of the block of between 1.5 meters and 3.5 meters. Alternative shapes of blocks are envisaged. One example of a block has a mean width 29 of 16.5 cms, a radius of the inner face is about 240 cms, a length 31 between centers is 151 cms, and a depth 34 between the surfaces 15 and 16 is about 15 cms.

Referring to FIG. 4, the inner face 11 is seen to be inclined downwardly and inwardly with respect to the block, and downwardly and outwardly with respect to the embankment. Thus, an inner edge 35 of the top face 15 projects outwardly with respect to the block beyond an inner edge 36 of the bottom face 16. This defines an overhanging inner face 11 of the block, which overhangs at an angle 38 to the vertical. The angle 38 is approximately 9.5 degrees (i.e. for a slope of 1 in 6) but the angle 38 can be between 0 and 45 degrees although 5 to 15 degrees is more practical. When the blocks are assembled into a wall, the angle 38 determines, to some extent, the slope of the outer face of the embankment, and is dependent on the material of the embankment, height of the embankment, and other geotechnical considerations. In practice, if the angle 38 is about 10 degrees it will accommodate most building situations. Clearly, the width of the block varies slightly between the top and bottom faces, and thus the average or mean width may be a useful guide. It is added that the angle 38 is convenient as a guide for the slope face when stacking the blocks in the wall.

Figure 1:
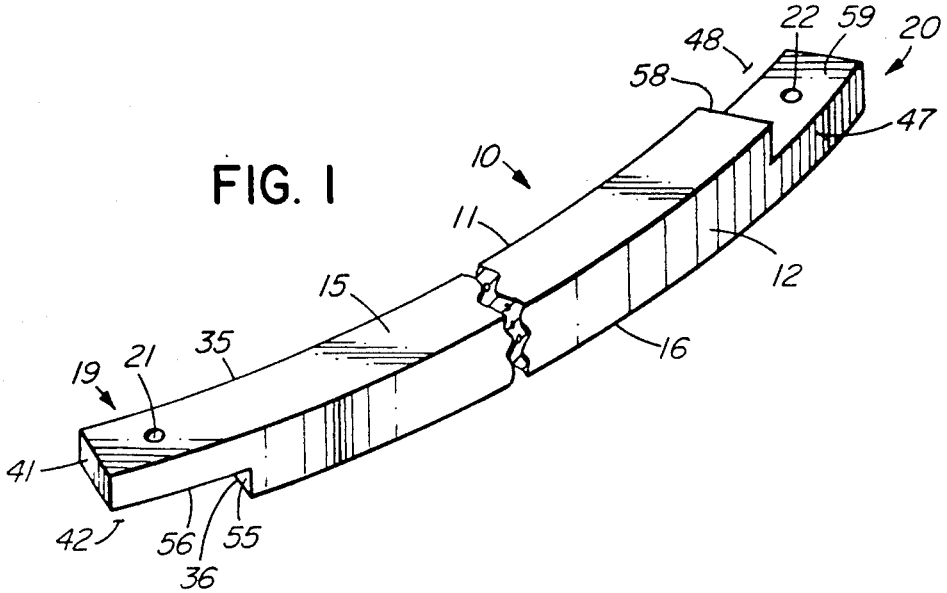
FIG. 1 is a fragmented perspective of a block according to the invention.
Figure 3:
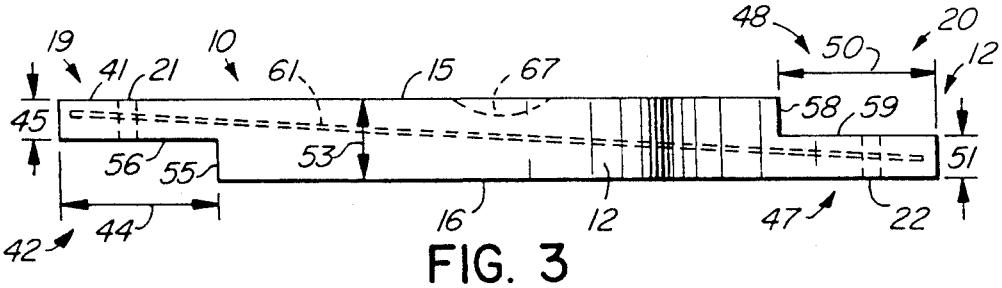
FIG. 3 is a front elevation of the block.

As best seen in FIGS. 1 and 3, the first end portion 19 has an overhang portion 41 projecting above a lower recess 42. The overhang portion has a length 44 and a depth 45, the length 44 being a maximum length as measured along a line which passes through the opening 21, as best seen in FIG. 2. The second end portion 20 has a step portion 47 projecting below an upper recess 48. The step portion has a length 50 and a depth 51, the length 50 being a maximum length as measured along a line which passes through the opening 22, as best seen in FIG. 2. The openings 21 and 22 are positioned approximately mid-way across the width of the block, as measured at a position half-way between the top and bottom faces.

The first end portion 19 has a concave overhang wall 55 extending between a lower face 56 of the overhang portion 41 and the bottom face 16 of the block. Similarly, the second end portion has a concave step wall 58 extending between an upper face 59 of the step portion 50 and the top face 15 of the block. The concave walls are centered on respective centers of curvature, which are generally concentric with adjacent openings in the end portions, but sufficient clearance must be maintained to permit limited rotation between adjacent blocks as will be described.

The lengths 44 and 50, and depths 45 and 51 permit interfitting between complementary end portions of adjacent blocks which are horizontally aligned with each other and which cooperate with each other to form a wall, as will be described with reference to FIGS. 5 through 10. Consequently, the depths 45 and 51 are approximately equal, or at least no greater than one-half of the depth 34 of the block, which represents vertical spacing between the walls 15 and 16. Clearly, the lengths 44 and 50 must be essentially equal, and are located with respect to the openings 21 and 22 to permit pairs of adjacent openings of adjacent blocks to be aligned with each other when the end portions of the adjacent blocks cooperate with each other in a wall as will be described with reference to FIGS. 5 through 10.

Assuming the block is fabricated from concrete, and has an overall length 32 greater than approximately 1 meter, a reinforcing bar 61 (broken line) is preferably provided to reinforce the block. As seen in FIG. 2, the bar is curved so as to conform to and be within the arcuate outline of the block, and extends between opposite end portions of the block. The bar 61 has a bar central portion 63 generally adjacent the outer face 12 of the block. The bar has bar end portions 65 and 66 disposed adjacent the inner face 11 of the block adjacent the end portions 19 and 20 respectively of the block. The term "adjacent" herein refers to a thickness of concrete which is provided between a portion of the bar and an adjacent face of the block as an amount which is sufficient to prevent corrosion of the bar due to water seeping through the concrete to the bar. Consequently, "adjacent" herein refers to a minimum spacing of about 12 mm which is a conventional minimal spacing between a reinforcing bar and an outer surface of concrete. Consequently, at the end portions 65 and 66 of the bar, the bar is spaced at a minimum distance of about 12 mm from the inner face 11, whereas the bar central portion 63 is spaced at a similar minimum distance of about 12 mm from the outer face 12. Clearly, assuming the bar is a portion of a circle, it has a radius that is smaller than the radius of the inner face 11.

It is noted that the bar end portions pass through the end portions 19 and 20 and thus reinforce narrower portions of the block 10 against bending and shear forces. The reinforcing bar provides additional strength to the end portions of the bar to resist bending within a vertical plane that would occur between adjacent blocks which are not located exactly within the same horizontal plane. Also, the end portions 65 and 66 of the reinforcing bar also increase strength of the block to resist bending within a horizontal plane, which arises from forces generated by securing the blocks to the embankment by tie-back rods as will be described. This is of particular advantage in the present invention and results in efficient load transfer to the portion of the block best suited to withstand tensile forces, namely the reinforcing bar. This is attained by reducing tensile stresses in concrete adjacent connections between adjacent blocks, the connections being provided by connecting rods passing through the openings 21 and 22 as will be described. Tensile stress reduction in the concrete is attained by providing a minimal amount of concrete between the end portions of the reinforcing bar and the openings 21 and 22 within the block. As best seen in FIG. 2, a minimum intermediate amount of concrete 68 is provided between an adjacent end portion of the bar and the closest wall of the opening 21. The intermediate amount of concrete 68 would have a thickness of 12 mm or slightly more, and thus is sufficient to prevent moisture seeping to the bar, and yet is not so large as to generate undesirably large tensile stresses within the concrete when subjected to restraining forces imposed by the rods.

FIGS. 5 THROUGH 10

A retaining wall 72 according to the invention retains the embankment 13 and comprises a plurality of stacked blocks 10 arranged in horizontal rows 74, one row on top of the other. The wall also comprises a plurality of generally vertical connecting rods 76 connecting the blocks together, and a plurality of generally horizontal tie back rods 78 embedded in the embankment 13. The tie back rods would normally be required for walls greater than about 1 meter in height.

Figure 5:
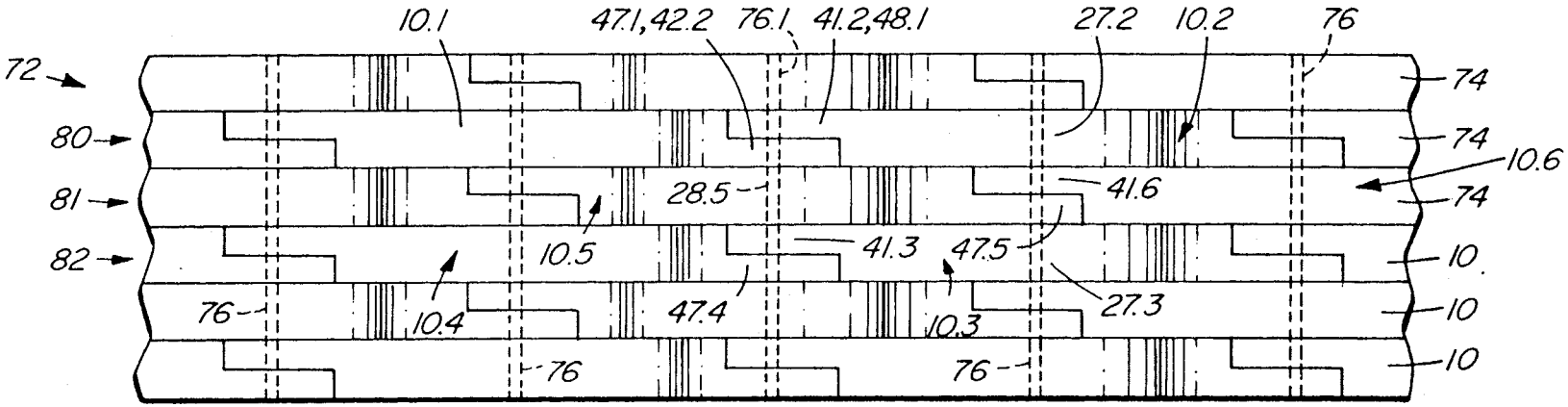
FIG. 5 is a simplified fragmented front elevation of a portion of a retaining wall built with blocks according to the invention.

As seen in FIG. 5, a typical first row of blocks, designated 80, has a plurality of similar blocks 10 as previously described, portions of each particular block being identified by the numerical references as designated in FIGS. 1 through 4, followed by a specific designation for each block such as 0.1, 0.2, 0.3, etc. Thus, with reference to the row of blocks 80, the block 10.1 has a step portion 47.1 which is received within a lower recess 42.2 of an adjacent block 10.2, while the overhang portion 41.2 of the block 10.2 is received within the upper recess 48.1 of the block 10.1.

The row of blocks 80 is positioned on a lower row of blocks 81, which in turn is positioned on an adjacent lower row of blocks 82. It can be seen that the overhang portion 41.3 and the step portion 47.4 of a pair of adjacent blocks 10.3 and 10.4 respectively in the row 82 are positioned vertically below the overhang portion 41.2 and the step portion 47.1 of adjacent blocks 10.2 and 10.1 in the row 80 which is separated from the row 82 by the row 81. In contrast, the step portion 47.5 and complementary overhang portion 41.6 of adjacent blocks 10.5 and 10.6 in the row 81 are positioned adjacent and between central portions 27.2 and 27.3 of the blocks 10.2 and 10.3 in the rows 80 and 82 respectively. Thus, joints between blocks in adjacent rows are staggered relative to each other as in conventional "running bond" rectangular brick building.

Figure 8:
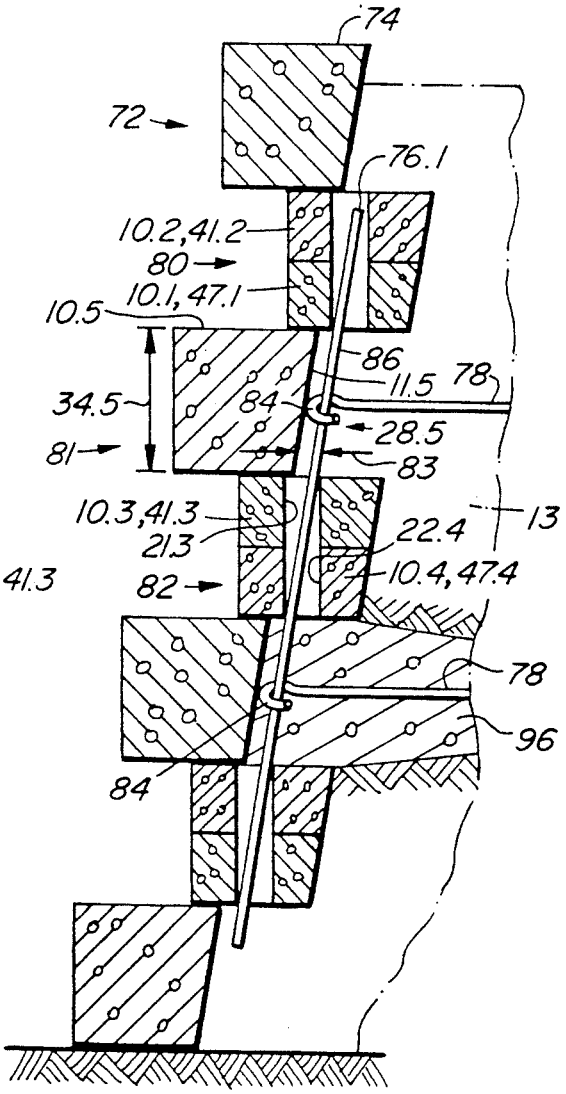
FIG. 8 is a simplified fragmented transverse section of a portion of the retaining wall, as seen from Line 8—8 of FIG. 6.

Referring to FIG. 8, first connecting rod 76.1 passes through the aligned openings in the overhang portion 41.2 and adjacent step portion 47.1, and similarly passes through aligned openings in the overhang portion 41.3 and step portion 47.4 in the row of blocks 82. While the rod 76.1 passes through the aligned openings in the overhang and step portions in the row 80, and the correspondingly aligned openings in the step portion and the overhang portion in the row 82, it passes clear of an inner face 11.5 of the block 10.5 in the row 81. It is noted that the rod 76.1 is generally parallel to the inclined rear face 11.5, and has an intermediate portion 86 which is spaced from the face 11.5 at a distance 83. The distance 83 is approximately 1 to 2 centimeters and sufficient to provide clearance for the rod 76.1 to receive a hook or an eye 84 adjacent an outer end of a respective tie back rod 78. Thus the rod 76.1 passes through the clearance means 28.5 of the block 10.5 which exposes the intermediate portion 86 of the connecting rod 76.1 to facilitate connection with the tie back rod 78. As is common in the trade, to provide sufficient latitude for assembly of the blocks, manufacturing tolerances of the rods, the openings 21 and 22 of the blocks, the position and angle of the faces of the blocks, etc. must be relatively wide to provide adequate clearance so that little difficulty is experienced in inserting the rod 76.1 through the two pairs of aligned openings, as well as through the hook or eye 84 at the end of the tie rod.

Thus, it can be seen that the rod 76.1 has a length equal to at least three times the depth 34 (FIG. 4) of the block, i.e. the depth 34.5 of the block 10.5. This length is necessary to enable the one length of rod 76.1 to pass through at least two pairs of aligned openings in two vertically spaced-apart rows of blocks, e.g. 80 and 82, the rows of blocks being separated by at least one intermediate row of blocks e.g. 81. Clearly, if the wall has been well built within a close tolerance, the rod 76 could be longer and thus could pass through five rows of blocks (as shown) or seven rows of blocks or more. However, it should be understood that it can be difficult to thread the rods through many blocks during construction, especially if tie rods are used for each alternate row of blocks. In summary, it is seen that the connecting rod 76.1 has an intermediate portion 86 which passes through the clearance of the block in the intermediate row, and is exposed for access for the eye 84 of the tie back rod, and is sufficiently long to span at least three rows of blocks.

The intermediate portion 86 of the rod has a length approximately equal to the depth 34.5 of the block 10.5, and this length is fully exposed for cooperation with an eye of a tie back rod. This provides a relatively wide vertical adjustment for the end of the tie back rod, which increases tolerance for placement of the tie back rods. In contrast to some prior art earthen embankment retaining walls, which have a cast-in ring on one location on the inner face of the block, the present invention provides a relatively wide tolerance for connection between the tie back rod and the connecting rods cooperating with blocks of the wall. Furthermore, for most retaining walls, or at least near an upper portion of the wall, it is not necessary for a tie back rod to be connected to each intermediate portion of a connecting rod. In some walls it would be possible to provide a connection to a respective tie back rod for alternate connecting rods, or for alternate intermediate portions of a specific connecting rod. This also increases the tolerance for fitting tie back rods, and permits the builder to select certain areas for tie back rods, thus avoiding particularly difficult areas of terrain if necessary.

Furthermore, inwards restraining force applied by the tie back rod to the block is transferred through side walls of the openings 21, 22 of the block essentially directly onto end portions of the reinforcing bar 61 (see FIG. 2) thus reducing distribution of stresses throughout the block. As previously described, at each end portion of the block, the bar end portion is disposed between the opening and the inner face of the block, with only the small intermediate amount 68 (FIG. 2) of concrete disposed therebetween. Thus this small amount of concrete is subjected mostly to compressive stresses, which concrete can easily resist. Thus, there is little tendency for the force from the connecting rod to break the block, as most of the force is transferred to the reinforcing bar 61 with negligible tensile forces in the adjacent concrete. Thus, there is essentially a direct transfer of force from the tie back rod 78, through the connecting rod 76, through the intermediate amount 68 and onto the reinforcing bar 61 of the block itself. Such direct transfer of force reduces stresses within the concrete itself considerably, thus reducing tendency of the blocks to fail.

Figure 9:
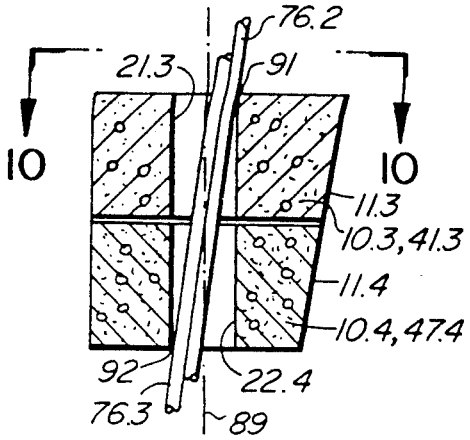
FIG. 9 is a simplified fragmented section also on Line 8—8 of FIG. 6, showing a portion of the wall in greater detail with an alternate connecting rod arrangement.
Figure 10:
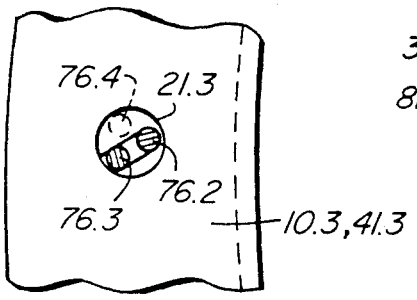
FIG. 10 is a simplified fragmented section on Line 10—10 of FIG. 9.

Referring to FIGS. 9 and 10, a portion of the wall adjacent the step portion 47.4 of the block 10.4 and the overhang portion 41.3 of the block 10.3 is shown cooperating with an alternative stacked arrangement of two connecting rods, designated 76.2 and 76.3 respectively. The block 10.3 has a first opening 21.3, and the block 10.4 has a second opening 22.4, the openings being of equal diameters and axially aligned with each other about a vertical axis 89 passing through the end portions. The inner faces 11.3 and 11.4 of the end portions of the blocks 10.3 and 10.4 are approximately parallel to each other and displaced relative to each other as shown.

The lower portion of the rod 76.2 is shown fitted within the aligned openings together with an upper portion of the rod 76.3, and, as seen in FIG. 10, the rods have diameters which permit easy insertion within the openings 22.4 and 21.3. Furthermore, the openings are of a diameter sufficient to receive the two stacked rods inclined obliquely to the vertical axis 89 at the angle 38, and as shown are fitted so that an inner or rear side of the rod 76.2 contacts an upper rear edge 91 of the opening 21.3, whereas an outer or forward side of the rod 76.3 contacts an lower front edge 92 of the opening 22 4. Clearances in the openings in the end portions must be sufficient to receive the connecting rods inclined at the angle 38, while passing through staggered vertical openings. In practice, it has been found that if nominal half-inch reinforcing bar is used, that is the diameter of the reinforcing bar is approximately 1 cm, the openings 22.4 and 21.3 should have diameters of approximately 3–4 cms. Clearly, the eye or hook of the tie back rod 78 should have a diameter sufficient to receive at least two rods 76.2 and 76.3, which can extend across the clearance openings in adjacent rows of blocks, and would provide a more secure connection between the blocks. For walls having particularly high stresses on lower rows thereof, two or three rods could pass through the aligned openings in the blocks, an optional third rod 76.4 being shown in broken outline in FIG. 10. The bundle of stacked two or three rods are received within the eye or hook of a tie back rod, thus reducing stresses in the connecting rods.

OPERATION

Figure 7:
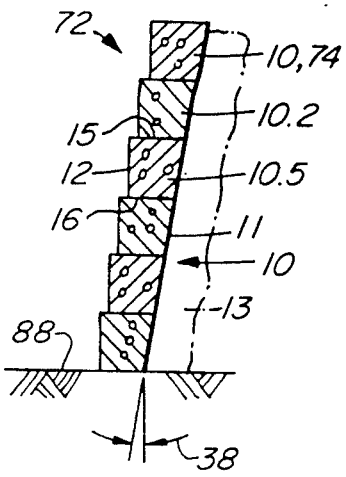
FIG. 7 is a simplified cross-section of the retaining wall, as seen from Line 7—7 of FIG. 6.

The site for the retaining wall is prepared in the normal manner, and usually the wall will be built initially as an essentially free standing wall on a horizontal bed 88, with concurrent back filling as required. The exposed face of the wall is characterized by a series of curved steps, corresponding to the staggered and stepped blocks. The inclination of the inner faces 11 causes the wall to lean back to the embankment at the angle 38. As seen in FIG. 7, adjacent vertically aligned portions of each block between the central portion and end portions of the block are generally co-planar to produce a generally smooth inner face of the wall. In contrast, as seen in FIG. 8, end portions of each block and corresponding central portions of adjacent vertically aligned blocks produce a series of staggered overhanging portions of blocks. It can also be seen that the generally vertical but obliquely inclined connecting rods 76 are alternately exposed and covered by the blocks to provide access for connecting to the tie back rods. It can be seen that the connecting rods pass through the aligned pairs of openings in the generally vertically staggered rows of blocks at an angle generally equal to the angle 38 of the inner face of the block, and thus, for simplicity, are referred to as "generally vertical".

As previously described with reference to FIG. 2, the concave walls 55 and 58 adjacent the end portion of the blocks are generally concentric with adjacent first and second openings 21 and 22 respectively. This is an approximate geometric relationship, and is necessary to permit limited relative rotation between adjacent blocks when interconnected by one or more connecting rods 76. Clearly, when the wall is being built in a straight line, alignment of the wall is controlled, usually by taut strings as in normal wall building. As the blocks are positioned relative to each other, it would be necessary to rotate one block relative to the other once it has been interconnected by a connecting rod. In this way, a corner of the end portion of one block would tend to sweep closely by the wall 55 or 58 of the adjacent block, depending upon which block is being rotated relative to the other. Clearly, sufficient clearance must be provided between the corner of one block and the concave wall of the other block. An example of such clearance is designated 94 in FIG. 6, and is usually between 1 and 4 mms. Thus, the clearance will not become excessive, e.g. due to accumulation of tolerances, such that soil from the embankment could pass through the gap between the corner of one block and the adjacent concave wall. This loss of soil is usually undesirable, and thus in many cases, the present invention can obviate the necessity in some prior art walls of providing geotechnical filler material, for example geotechnical membranes, to seal excessively large gaps between adjacent blocks. In general, it is preferred to have some clearance to increase tolerance of the building of the wall, rather than insufficient clearance which would require a mason to chisel portions of the blocks away to permit interfitting between adjacent blocks.

During construction of the wall, if the embankment is being built up with back fill, as the height of the wall increases, the tie back rods can be threaded on the connecting rods as necessary, or the connecting rods can be passed through the tie back rods as they are installed in the bank. Alternatively, if the bank is already in existence and is close to the wall and the inner face of the wall requires only a relatively small volume of back fill, the tie back rods are first driven into the existing embankment and retained therein. The outer end of the rod with the eye can then be positioned to receive the connecting rod threaded therethrough. In either instance, the tie back rod has an outer end connected to an intermediate portion of a respective connecting rod, and an inner end is restrained against movement within the embankment.

As previously stated, when relatively short connecting rods are used, or if additional strength is required, two or three connecting rods would pass through each pair of aligned openings or cooperating blocks. Thus, for a very high wall, where considerable stresses might be experienced by the lower blocks and associated connecting rods, a stack of two or three connecting rods can pass through aligned openings in the blocks, and be received in the outer end of the eye of the tie back rod.

ALTERNATIVES

Preferably the block is arcuate in plan with a convex outer face and concave inner face as shown to reduce weight and materials used. However, the outer face could be straight or planar, to produce a wall having rows of plane-faced, shallow-edged steps.

In some applications, primarily to reduce rod corrosion, it is would be preferable to embed within concrete the rods in the openings and the connection between the hook or eye 84 of the tie back rod 78 and the intermediate portion 86 of the connecting rod 76. Referring to FIG. 8, a stiff plastic concrete mass is shown applied in one place in broken outline at 96, and is positioned around the connection between the rods 76 and 78 and between the projecting blocks. The mass of concrete is relatively stiff, and is supported on the backfill material which provides a "mold" to receive a portion of the mass. A much thinner grout mixture is poured through the aligned openings 21.3 and 22.4 of adjacent blocks immediately above the connection, the grout flowing through the aligned openings and downwardly onto the mass of concrete immediately beneath the openings. Preferably all portions of the tie back and connecting rods are embedded in concrete so that concrete completely covers all exposed rods. Preferably, to reduce corrosion, the tie back rod 78 should be pre-cast and enclosed in concrete. With such an arrangement, all tie back rods and connecting rods would be encased in concrete, thus reducing corrosion and simultaneously strengthening the connections of the rods with the blocks.

For some applications, it might be desirable to deliberately provide access to soil of the embankment, through selected portions of the wall. This could be for environmental considerations, e.g. where the retaining wall is used to prevent sliding of the embankment into a waterway, and it is desired to provide areas for vegetation to overhang the waterway, for habitat enhancement for wildlife. This can easily be attained by providing additional clearance by way of a cut-out 67 (shown in broken outline only in FIGS. 2 and 3), which increases clearance between adjacent rows of blocks and permits vegetation to sprout between the rows. The cut-out 67 can easily be incorporated into casting molds for the blocks by providing a removable core as needed. Clearly, it is not necessary to use such a cut-out in every block.

While the rear face is shown to be concave, other means to produce a clearance at the central portion of the block are envisaged. For example, if the rear face 11 were essentially straight, or curved less than the outer face 12, additional clearance means at the central portion of the block could be provided as shown generally in broken outline at 67 in FIGS. 2 and 3. This additional clearance would be sufficient to pass through the full depth of the block (which is not as shown in FIG. 3) and this would be necessary to provide access to the connecting rod passing through the block and adjacent the central portion of the inner face 11. Thus, not only would soil from the embankment wall be exposed through the cut-out 67, but clearance would also be provided to provide access for the tie back rod to the connecting rod, without requiring a completely curved inner face 11.

Figure 6:
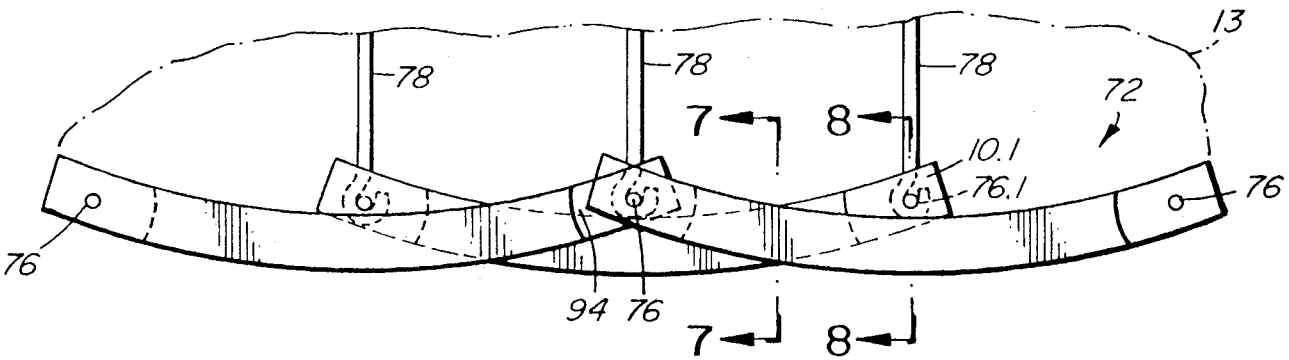
FIG. 6 is a simplified fragmented top plan of the portion of the retaining wall of FIG. 5, an upper layer of blocks not being shown.

In FIG. 6, the blocks are shown to be disposed in an essentially straight line, so that the longitudinal axes 24 (FIG. 2) of the blocks are aligned with each other i.e. adjacent axes 24 are disposed at 180 degrees relative to each other. This would be the normal installation for producing generally planar walls, although clearly, the outer face of the wall would have a series of short curves and steps as previously described. For some applications, curved embankment walls are required, and the present invention can produce curved walls with some limitations as follows.

If the wall is to be curved in a direction contrary to the curvature of the block, adjacent blocks can be positioned relative to each other so that longitudinal axes of the blocks are disposed at angles less than 180 degrees, typically no less than a minimum angle of 120 degrees. When so positioned, the connecting rods are spaced at a greater distance from the inner faces 11 of the adjacent blocks than when the blocks are disposed in a straight line. Clearly, limits of the degree of curvature of the resulting retaining wall will vary depending on the geometry of the blocks.

If the wall is to be curved in a direction similar to the curvature of the blocks, additional limitations are imposed on the angle between longitudinal axes of adjacent blocks because in this arrangement the connecting rods are moved closer towards the inner faces 11 of the blocks than when the blocks are aligned. Unless larger clearance means 28 is provided adjacent mid portion of each inner face 11, i.e. a relatively deep recess within the face 11, the blocks cannot be set in an excessively curved wall. Clearly, curved walls formed from blocks of the present invention present some difficulties in design, and, unless straight walls are to be built, specially shaped blocks would usually be required.

I claim:

1. A building block for a retaining wall, the block comprising:

(a) spaced apart inner and outer faces, and spaced apart generally parallel top and bottom faces, the faces defining a transverse cross-section of the block, (b) first and second end portions, the end portions being complementary to each other and having respective openings therein positioned to permit adjacent end portions of adjacent blocks to cooperate with each other so that pairs of adjacent openings are alignable with each other, the openings of a particular block being disposed on a straight longitudinal axis of the block, (c) a clearance means located adjacent the longitudinal axis and adjacent a central portion of the inner face of the block.

2. A block as claimed in claim 1, in which:

(a) the first end portion has an overhang portion projecting above a lower recess, (b) the second end portion has a step portion projecting below an upper recess, (c) the overhang portion and the step portion having respective lengths and depths to permit interfitting therebetween when adjacent blocks are horizontally aligned with each other and cooperate with each other to form a wall, (d) the overhang portion and the step portion have the respective openings which can be aligned with each other when the end portions of the adjacent blocks cooperate with each other.

3. A block as claimed in claim 2, in which:

(a) the first end portion has a concave overhang wall extending between a lower face of the overhang portion and the bottom face of the block, the concave step wall being generally centered on the opening in the overhang portion (b) the second end portion has a concave step wall extending between an upper face of the step portion and the top face of the block, the concave step wall being generally centered on the opening in the step portion.

4. A block as claimed in claim 1, in which:

(a) the inner face is generally concave so that the central portion thereof is recessed relative to the end portions to form the clearance means, and the longitudinal axis extends as a chord, with respect to the inner face, between the openings in the opposite end portions of the block.

5. A block as claimed in claim 4, in which:

(a) the outer face is generally convex and spaced from the inner face at a generally constant perpendicular distance, so that the block has an essentially constant width and forms an approximate arc of a circle.

6. A block as claimed in claim 1, in which:

(a) the inner face is inclined downwardly and inwardly with respect to the block, so that an inner edge of the top face of the block projects outwardly with respect to the block beyond an inner edge of the bottom face of the block, thus defining an overhanging inner face of the block.

7. A block as claimed in claim 1, in which:

(a) the block is fabricated from concrete, (b) a reinforcing bar extends between opposite end portions of the block, the reinforcing bar having a bar central portion disposed generally adjacent the outer face of the block, and bar end portions disposed adjacent the inner face of the block adjacent the end portions of the block.

8. A block as claimed in claim 5, in which:

(a) the block is fabricated from concrete, (b) a reinforcing bar extends between opposite end portions of the block, and is curved so as to conform to be within an outline of the block, the reinforcing bar having a bar central portion generally adjacent the outer face of the block, and bar end portions disposed adjacent the inner face of the block adjacent the end portions of the block, (c) at each end of the block the bar end portion is disposed between the opening and the inner face.

9. A block as claimed in claim 6, in which:

(a) the inner face is inclined to the vertical at an angle of between 5° and 15°.

10. A wall comprising a plurality of stacked blocks arranged in horizontal rows, one on top of the other, and a plurality of rods cooperating with the blocks, in which each block comprises:

(a) spaced apart inner and outer faces, and spaced apart generally parallel top and bottom faces, the faces defining a transverse cross-section of the block, (b) first and second end portions, the end portions being complementary to each other and having respective openings therein positioned to permit adjacent end portions of adjacent blocks to cooperate with each other so that pairs of adjacent openings are alignable with each other, the openings of a particular block being disposed on a straight longitudinal axis, (c) a clearance means located adjacent the longitudinal axis and adjacent a central portion of an inner face of the block, the end portions of the blocks in a lower row being disposed beneath central portions of the blocks in an adjacent upper row, and the plurality of rods comprises:

(d) a plurality of generally vertical connecting rods, each connecting rod passing through at least two pairs of aligned openings in two vertically spaced apart rows of blocks, which rows of blocks are separated by at least one intermediate row of blocks, and in which an intermediate portion of a particular rod passes through the clearance means of a block in the intermediate row of blocks, the intermediate portion of the particular rod being exposed for access.

11. A wall as claimed in claim 10, in which each block is characterized by:

(a) the first end portion having an overhang portion projecting above a lower recess, (b) the second end portion having a step portion projecting below an upper recess, (c) the overhang portion and the step portion having respective lengths and depths to permit interfitting therebetween when adjacent blocks are horizontally aligned with each other and cooperate with each other to form a wall, (d) the overhang portion and the step portion having the respective openings which can be aligned with each other when the end portions of the adjacent blocks cooperate with each other to receive a respective connecting rod to connect the end portions together.

12. A wall as claimed in claim 10, in which each block is characterized by:

a) the inner face being generally concave so that the central portion thereof is recessed relative to the end portions to form the clearance means, and the longitudinal axis extends as a chord, with respect to the inner face, between the openings in the opposite end portions of the block.

13. A wall as claimed in claim 10 for use as a retaining wall to support a relatively high embankment, the wall further including:

(a) a plurality of generally horizontal tie back rods, each tie back rod having an outer end connected to the intermediate portion of a respective connecting rod, and an inner end restrained against movement within the embankment.

14. A wall as claimed in claim 13, in which each block is characterized by:

(a) the first end portion having an overhang portion projecting above a lower recess, (b) the second end portion having a step portion projecting below an upper recess, (c) the overhang portion and the step portion having respective lengths and depths to permit interfitting therebetween when adjacent blocks are horizontally aligned with each other and cooperate with each other to form a wall, (d) the overhang portion and the step portion having the respective openings which can be aligned with each other when the end portions of the adjacent blocks cooperate with each other top receive a respective connecting rod to connect the end portions together.

15. A wall as claimed in claim 14, in which:

(a) the first end portion of each block has a concave overhang wall extending between a lower face of the overhang portion and the bottom face of the block, (b) the second end portion of each block has a concave step wall extending between an upper face of the step portion and the top face of the block.

16. A wall as claimed in claim 13 in which:

(a) the inner face of each block is generally concave so that the central portion thereof is recessed relative to the end portions to form the clearance means, and the longitudinal axis extends as a chord, with respect to the inner face, between the openings in the opposite end portions of the block.

17. A wall as claimed in claim 13, in which:

(a) the outer face of each block is generally convex and spaced from the inner face at a generally constant perpendicular distance, so that the block has an essentially constant width and forms an approximate arc of a circle.

18. A wall as claimed in claim 13, in which:

(a) the inner face of each block is inclined downwardly and inwardly with respect to the block, so that an inner edge of the top face of the block projects outwardly with respect to the block beyond an inner edge of the bottom face of the block, thus defining an overhanging inner face of the block.

19. A wall as claimed in claim 13, in which:

(a) each block is fabricated from concrete, (b) a reinforcing bar extends between a opposite end portions of each block, the reinforcing bar having a bar central portion disposed generally adjacent the outer face of the block, and bar end portions disposed generally adjacent the inner face of the block adjacent the end portions of the block, (c) at least one connecting bar passes through aligned openings adjacent the end portions of two blocks, and a relatively small intermediate amount of concrete is disposed between the connecting rod and an adjacent bar end portion of the reinforcing bar of each block.

20. A wall as claimed in claim 13, in which:

(a) the connecting rods in the openings of the end portions of the bar, and a connection between a tie back rod and the connecting rod are embedded in concrete to reduce corrosion.

* * * * *